United States Patent [19]

Marshall et al.

[11] 4,054,634

[45] Oct. 18, 1977

[54] PRODUCTION OF POLYESTER TIRE YARN

[75] Inventors: Robert Moore Marshall, Chester; Kimon Constantine Dardoufas, Richmond, both of Va.

[73] Assignee: Allied Chemical Corporation, Morris Township, N.J.

[21] Appl. No.: 617,547

[22] Filed: Sept. 29, 1975

[51] Int. Cl.[2] ..... B05D 1/38; B05D 3/12

[52] U.S. Cl. ..... 264/210 F; 264/137; 427/175; 427/401; 427/407 R; 156/110 C; 428/391; 428/395

[58] Field of Search ..... 427/175, 407 R, 412; 156/110 C, 110 MD; 428/394, 395, 391; 252/8.9; 264/210 F, 137

[56] References Cited

U.S. PATENT DOCUMENTS

| | | | |
|---|---|---|---|
| 2,425,755 | 8/1947 | Roberts et al. | 260/615 B |
| 2,964,470 | 12/1960 | Wentworth | 252/8.9 X |
| 3,583,878 | 6/1971 | Ragep et al. | 427/175 |
| 3,730,892 | 5/1973 | Marshall et al. | 252/8.75 |

*Primary Examiner*—Ronald H. Smith
*Assistant Examiner*—Evan K. Lawrence
*Attorney, Agent, or Firm*—Fred L. Kelly

[57] ABSTRACT

In a process for producing polyethylene terephthalate yarn, particularly for tire cords, wherein a liquid finish is applied to the yarn, said process involving spinning and drawing steps, the improvement comprising: (a) first applying to the yarn prior to said drawing step a liquid finish composition consisting essentially of a polyalkylene glycol compound which is a mixed polyoxyethylated-polyoxypropylated monoether prepared in accordance with the equation:

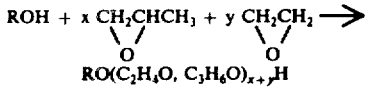

where R is an alkyl group having 1 to 8 carbon atoms, $x$ and $y$ are the number of moles of propylene oxide and ethylene oxide respectively and wherein ethylene oxide comprises 40 to 60 percent by weight of the combined total of ethylene oxide and propylene oxide and $x+y$ has a value to produce a molecular weight of from 300 to 1,000; and then (b) applying to said yarn after said drawing step a liquid finish composition consisting essentially of about 70 to 95 parts by weight of said mixed polyoxyethylated-polyoxypropylated monoether, about 5 to 30 parts by weight of a silane having the structural formula:

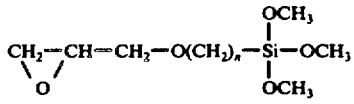

wherein $n$ = 2 to 5, and a sufficient amount of a water-soluble alkaline catalyst to adjust the pH of the finish composition to 8–10.

6 Claims, No Drawings

PRODUCTION OF POLYESTER TIRE YARN

CROSS-REFERENCES TO RELATED APPLICATIONS

This application is related to our copending U.S. application Ser. No. 589,974, filed June 24, 1975.

BACKGROUND OF THE INVENTION

This invention relates to multifilament yarns and particularly to improved multifilament polyethylene terephthalate yarns for industrial uses. More particularly, it relates to an improved multifilament polyethylene terephthalate yarn and a new fiber finishing process for polyethylene terephthalate yarns in which novel fiber finish compositions are applied to said yarns. Still more particularly, it relates to a fiber finish composition designed specifically for subsequent single dip tire cord processing for polyethylene terephthalate yarns.

Many fiber finish compositions are known. Some are quite specific in composition and relate to specific type fibers. Small changes in fiber finish composition frequently result in tremendous improvements in not only processing but also in end use of the fiber. One problem is that two chemical dip treatments are normally required for polyester tire cord in order to obtain fiber to rubber adhesion required in the use of fiber in tires.

Our U.S Pat. No. 3,730,892, issued May 1, 1973, provides a new approach to improve the dual finish system. It provides a method by which reactive adhesion promoting chemicals are applied to the yarn after the draw zone thus avoiding the critical process conditions. The method of the patent also allows the elimination of the conventional isocyanate dip in cord processing. Briefly stated, the patent discloses an improved multifilament polyethylene terephthalate yarn and process for producing said yarn, said yarn being combined with a compatible fiber finish composition of about 45 to 50 parts by weight of hexadecyl (isocetyl) stearate; about 4 to 6 parts by weight of glycerol monooleate; about 3.5 to 5.5 parts by weight of decaglycerol tetraoleate; about 5.5 to 8.1 parts by weight of polyoxyethylene tall oil fatty acid; about 8.0 to 10.0 parts by weight sulfonated glycerol trioleate; about 2.0 to 3.0 parts by weight polyoxyethylene tall oil amine; about 1.0 to 2.0 parts by weight 4,4′ thiobis (6-tert-butyl-m-cresol); and about 5 to 30 parts by weight of a silane having the structural formula

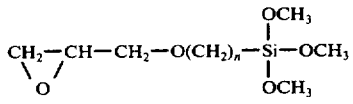

wherein $n = 2$ to 5.

Although the product and process of U.S. Pat. No. 3,730,892 are considered an important contribution to this art, our research in this field has continued in an effort to develop an even better process and/or product. Clearly, it would be a significant advance to find a finish consisting of only one or two components that could be used as a spin finish or as an overfinish to provide an improved tire yarn with excellent properties for use in tires.

Accordingly, a prime object of this invention is to provide an improved polyester yarn and an improved fiber finishing process for polyethylene terephthalate yarns in which novel fiber finish compositions are applied to said yarns. Other objects will be apparent from time to time in the following specification.

SUMMARY OF THE INVENTION

These and other objects are accomplished in accordance with the process of the present invention which is briefly stated as follows:

In a process for producing polyethylene terephthalate yarn wherein a liquid finish is applied to the yarn, said process involving spinning and drawing steps, the improvement comprising:

a. first applying to the yarn prior to said drawing step a liquid finish composition consisting essentially of a polyalkylene glycol compound which is a mixed polyoxyethylated-polyoxopropylated monoether prepared in accordance with the equation:

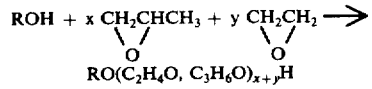

where R is an alkyl group having 1 to 8 carbon atoms, $x$ and $y$ are the number of moles of propylene oxide and ethylene oxide respectively and wherein ethylene oxide comprises 40 to 60 percent by weight of the combined total of ethylene oxide and propylene oxide and $x+y$ has a value to produce a molecular weight of from 300 to 1,000; and then b. applying to said yarn after said drawing step a liquid finish composition consisting essentially of about 70 to 95 parts by weight of said mixed polyoxyethylated-polyoxypropylated monoether, about 5 to 30 parts by weight of a silane having the structural formula:

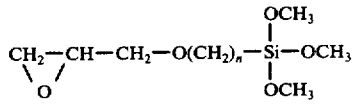

wherein $n = 2$ to 5, and a sufficient amount of a water-soluble alkaline catalyst to adjust the pH of the finish composition to 8–10.

DESCRIPTION OF THE PREFERRED EMBODIMENT

The preferred polyalkylene glycol compounds of the present invention are so-called random copolymers, preferably, random copolymers made from ethylene oxide and propylene oxide. Ethylene oxide and propylene oxide are reacted simultaneously to form mixed polyalkylene glycol compounds. For example, with alcohols, mixed polyoxyethylated-polyoxypropylated monoethers result in accordance with the following equation:

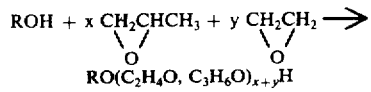

where R is as described above, where $x$ is the number of moles of propylene and $y$ is the number of moles of ethylene oxide. We prefer to use such compounds which are condensation products of 40 to 60 percent ethylene oxide and 40 and 60 percent propylene oxide on a weight basis, terminated with an alcohol containing 3 to 5 carbon atoms. Typical prior art in this field includes U.S. Pat. No. 2,425,755 and U.S. Pat. No. 2,425,845.

Polyalkylene glycols and their derivatives made by such procedures are sold under the trade-name Ucon (Union Carbide Corporation). The code number after the series designation indicates the viscosity at 100° F. in Saybolt universal seconds (S.U.S.) in the Ucon series. All members of the Ucon 50-HB and Ucon 75-H series are water soluble while the Ucon LB and Ucon D series are water-insoluble. For use in the present invention, the water-soluble compounds are preferred. Optimum results have been obtained with polyoxyethylated-polyoxypropylated monoethers which are condensation products of 50 percent ethylene oxide and 50 percent propylene oxide terminated with butyl alcohol said monoethers having a viscosity of 75–300 S.U.S., preferably 100 to 200 S.U.S.

The preferred process of the present invention is briefly stated as follows:

In a process for producing polyethylene terephthalate yarn wherein a liquid finish is applied to the yarn, said process involving spinning and drawing steps, the improvement comprising:

a. first applying to the yarn prior to said drawing step from about 0.2 to about 0.6 weight percent, based on the weight of the yarn, of a liquid finish composition consisting essentially of a polyalkylene glycol compound which is a mixed polyoxyethylated-polyoxypropylated monoether prepared in accordance with the equation:

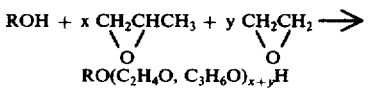

where R is an alkyl group having 3 to 5 carbon atoms, $x$ and $y$ are the number of propylene oxide and ethylene oxide respectively and wherein ethylene oxide comprises 40 to 60 percent by weight of the combined total of ethylene oxide and propylene oxide and $x+y$ has a value to produce a molecular weight of from 500 to 850; and then b. applying to said yarn after said drawing step from about 0.3 to about 1.3 weight percent, based on the weight of the yarn, of a liquid finish composition consisting essentially of about 70 to 95 parts by weight of said mixed polyoxyethylated-polyoxypropylated monoether, about 5 to 30 parts by weight of a silane having the structural formula:

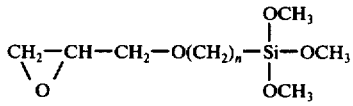

wherein $n$ = 2 to 5, and a sufficient amount of a water-soluble alkaline catalyst to adjust the pH of the finish composition to 8–10. Suitable catalysts include sodium hydroxide, potassium hydroxide, sodium carbonate, potassium carbonate, sodium acetate, potassium acetate, and organic amine compounds such as triethanol amine, hexamethylenediamine and piperazine.

The product yarn of the process of the present invention may be twisted and plied into tire cord. Typically, a yarn having a total denier of about 1300 is twisted 8 turns per inch, 3 plies are then twisted in reverse direction 8 turns per inch to form a cord referred to as 1300/3.8/8. The polyester cord is then treated with a 20 percent solids dispersion of a conventional R/F/L adhesive composition made in accordance with the following formula in amount sufficient to give a dry solids pick up from 6 to 7 percent.

| R/F/L Adhesive | |
|---|---|
| Ingredients | Parts |
| Resorcinol | 98 |
| Formaldehyde (37%) | 53 |
| Terpolymer rubber latex of styrene/butadiene-1,3/vinylpyridine 15/70/15 (41%) | 1152 |
| Water | 543 |

The resulting cords are then tensilized in a conventional tensilization procedure. The conventional isocyanate dip is not required. The time-temperature relationship of the tensilization heat treatment must be carefully controlled so that the fiber properties do not suffer impairment. Too long a treatment, even at preferred temperatures will tend to degrade the fibers. Normally, the heat treating step will be carried out so that the surface of the fibers will be raised rapidly to a temperature of 200° C. to 230° C., preferably 215° C. to 230° C. and kept at that temperature for up to 160 seconds. A satisfactory criterion for determining the best time/temperature relationship is to measure the heat stability of the fiber, both heat treated and untreated. Of course, the heat treatment should significantly improve the heat stability of the fiber. Any means for heating the surface of the fiber may be used and a large variety of suitable apparatus is available in the trade.

The adhesion between the cord and rubber may be tested by any conventional test used by tire manufacturers. For example, the adhesion test disclosed in U.S. Pat. No. 3,718,587, issued Feb. 27, 1973, and assigned to The Goodyear Tire and Rubber Company, may be used. In accordance with this patent, peel adhesion is determined in the following manner. Onto the surface of a 12 mil thick sheet (12 inch × 12 inch) of rubber (MRS) is laid the treated cords at the rate of 18 per inch which are then covered with a second sheet (12 inch × 12 inch) of 12 mil gauge rubber (MRS). This "sandwich" arrangement of rubber cord and rubber is then doubled onto itself with a piece of Holland cloth extending one inch into the doubled assembly from the open end from which assembly is clipped 1 inch × 3 inch samples, which samples are then cured in a mold. The cured sample is then placed in an Instron machine, heated at 250° F. and the two strips of rubber separated by the Holland cloth are then moved in opposite directions at the rate of 2 inches per minute to determine the average force (A) required to separate the remaining portion of the sample. Depending on the adhesion developed between the cord and rubber, separation either occurs at the rubber/rubber interface or the rubber/cord interface or at both in varying amounts. After separation has been completed, the amount of rubber remaining (B) on the cord is determined by visual inspection. Peel force (A) is conveniently recorded in ounces, and the amount of rubber remaining (B) on the cord is determined by visual inspection; it is conveniently given a rating of 0 to 5, where 5 is the optimum rating indicating that adhesion is so great that the cord is completely covered with rubber, and 0 is the lowest rating indicating that adhesion is so poor that the cord is completely exposed.

In order to demonstrate the invention, the following examples are given. They are provided for illustrative purposes only and are not to be construed as limiting the scope of the invention, which is defined by the appended claims. All parts and percents are by weight unless otherwise stated.

EXAMPLE 1

This example demonstrates that the polyglycol ether finish system of the present invention can be used with excellent results in a conventional spindraw process for producing polyethylene terephthalate yarn. The polyglycol ether used was a condensation product of 50 percent ethylene oxide and 50 percent propylene oxide terminated with butyl alcohol and having a molecular weight of about 570 and a viscosity of 100 S.U.S. at 100° F. This polyglycol ether was applied directly, i.e., without diluting with water, as a spin finish to polyethylene terephthalate tire yarn (approximately 1300 denier, 192 filaments) by means of a kiss roll prior to drawing the yarn. About 0.4 weight percent of the spin finish was applied based on the weight of the yarn. After drawing, the yarn was heated to 135°-230° C. on relax rolls. Less than 15 percent of the finish was volatilized during this heating step. Then, about 0.7 percent based on the weight of the yarn of a modified polyglycol ether overfinish was applied to the yarn. This overfinish consisted of 40 parts of the same polyglycol ether used in the spin finish, 10 parts of gamma-glycidoxypropyltrimetholysilane, 50 parts of water, and sufficient amount of 5 percent aqueous NaOH solution to adjust the pH of the finish solution to about 8.0-8.5. About 2 parts of the NaOH solution was required. The finished yarn was readily twisted and plied into greige cord. The resulting cord was then treated with a conventional R/F/L adhesive composition as described hereinabove and tensilized by a conventional tensilization procedure. The conventional isocyanate dip was omitted.

The adhesion between the resulting cord and rubber was tested in the above-described peel adhesion test where the peel force and visual rating of the amount of rubber remaining on the cord is recorded. Results are shown in Table I for samples prepared at various molding temperatures.

TABLE I

| Molding Temperature, ° F. | Peel Adhesion, oz. | Visual Rating |
|---|---|---|
| 350 | 224 | 1.8 |
| 400 | 272 | 2.5 |
| 450 | 384 | 4.2 |

In a comparative test, a tire yarn prepared as above but without addition of the NaOH as catalyst showed peel adhesion values of only 256 ounces and visual ratings of only 1.5 at a molding temperature of 450° F. This clearly indicates the criticalness of using the alkaline catalyst in the process of the present invention.

EXAMPLE 2

The procedure of Example 1 was followed except that triethanolamine was used as the alkaline catalyst instead of sodium hydroxide. The peel adhesion between the tire and rubber was excellent, i.e., the above-described test showed peel adhesion values of 400 ounces and visual ratings of 4.2. Similar results were obtained with potassium hydroxide and other water-soluble alkaline catalysts tested.

EXAMPLE 3

The procedure of Example 1 was followed except that the polyoxyethylated-polyoxypropylated monoether applied to the yarn had a molecular weight of 360 and a viscosity of 55 S.U.S. at 100° F. This finish tended to fume during heating of the fiber to 215°-230° C.; however, adhesion properties of the yarn were comparable to the yarn of Example 1.

EXAMPLE 4

The procedure of Example 1 was followed except that the polyalkylene glycol ether applied to the yarn was 100 percent polyethylene glycol ethers with molecular weights ranging from 300 to 600. Yarn performance, quality, static and friction were good but adhesion to rubber was relatively poor as compared with the product of Example 1.

EXAMPLE 5

The procedure of Example 1 was followed except that the polyalkylene glycol finish applied to the yarn was an aqueous solution of Ucon-50-HB-660 having a molecular weight of about 1670 and a viscosity of 660 S.U.S. at 100° F. This finish gave relatively poor lubrication of the yarn which caused a significantly higher number of broken filaments as compared with yarn of Example 1.

EXAMPLE 6

The procedure of Example 1 was followed except that the polyalkylene glycol ether applied to the yarn was 100 percent polypropylene glycol ethers having a viscosity of 135 S.U.S. at 100° F. This finish did not provide adequate static protection to the fiber which caused a significantly higher number of broken filaments as compared with the yarn of Example 1.

We claim:

1. In a process for producing polyethylene terephthalate yarn, particularly for tire cords, wherein a liquid finish is applied to the yarn, said process involving spinning and drawing steps, the improvement comprising:

a. first applying to the yarn prior to said drawing step from about 0.2 to about 0.6 weight percent, based on the weight of the yarn, of a liquid finish composition consisting essentially of a polyalkylene glycol compound which is a mixed polyoxyethylated-polyoxypropylated monoether prepared in accordance with the equation:

$$ROH + x\,\underset{\diagdown O \diagup}{CH_2CHCH_3} + y\,\underset{\diagdown O \diagup}{CH_2CH_2} \longrightarrow RO(C_2H_4O,\ C_3H_6O)_{x+y}H$$

where R is an alkyl group having 1 to 8 carbon atoms, $x$ and $y$ are the number of moles of propylene oxide and ethylene oxide respectively and wherein ethylene oxide comprises 40 to 60 percent by weight of the combined total of ethylene oxide and propylene oxide and $x+y$ has a value to produce a molecular weight of from 500 to 850; and then b. applying to said yarn after said drawing step from about 0.3 to about 1.3 weight percent, based on the weight of the yarn, of a liquid finish composition consisting essentially of an aqueous solution of about 70 to 95 parts by weight of said mixed polyoxyethylated-polyoxypropylated monoether, about 5 to 30 parts by weight of a silane having the structural formula:

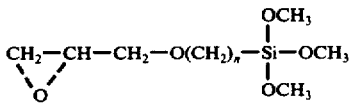

wherein $n = 2$ to 5, and a sufficient amount of a water-soluble alkaline catalyst to adjust the pH of the finish composition to 8–10.

2. The process of claim 1 wherein the silane is gamma-glycidoxypropyltrimethoxysilane.

3. The process of claim 1 wherein the alkaline catalyst is selected from the group consisting of sodium hydroxide, potassium hydroxide and triethanolamine, and a sufficient amount of said alkaline catalyst is present to adjust the pH of the finish composition to 8.0–8.5

4. The process of claim 3 wherein the alkaline catalyst is sodium hydroxide.

5. The process of claim 3 wherein the alkaline catalyst is potassium hydroxide.

6. The process of claim 3 wherein the alkaline catalyst is triethanolamine.

* * * * *